US010287137B2

(12) United States Patent
Kawai et al.

(10) Patent No.: US 10,287,137 B2
(45) Date of Patent: May 14, 2019

(54) WINCH CONTROL APPARATUS AND CRANE

(71) Applicants: Kobe Steel, Ltd., Kobe-shi (JP); KOBELCO CONSTRUCTION MACHINERY CO., LTD., Hiroshima-shi (JP)

(72) Inventors: Hiroaki Kawai, Kobe (JP); Takashi Tokuyama, Kobe (JP); Toshiaki Shimoda, Kobe (JP); Koji Inoue, Kobe (JP); Tetsuya Ogawa, Hyogo (JP); Shintaroh Sasai, Hyogo (JP)

(73) Assignees: Kobe Steel, Ltd., Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 15/889,700

(22) Filed: Feb. 6, 2018

(65) Prior Publication Data

US 2018/0229976 A1 Aug. 16, 2018

(30) Foreign Application Priority Data

Feb. 14, 2017 (JP) ..... 2017-024712

(51) Int. Cl.
*B66C 13/22* (2006.01)
*B66C 13/28* (2006.01)
(Continued)

(52) U.S. Cl.
CPC ..... *B66C 13/22* (2013.01); *B66C 13/28* (2013.01); *B66C 23/62* (2013.01); *B66D 1/46* (2013.01); *B66C 2700/08* (2013.01)

(58) Field of Classification Search
CPC ..... B66C 13/12; B66C 13/22; B66C 13/28; B66C 13/62; B66C 2700/08; B66D 1/12; B66D 1/485
See application file for complete search history.

(56) References Cited

U.S. PATENT DOCUMENTS 3,248,625 A * 4/1966 Wycoff ..... B66C 13/26 318/258
3,943,713 A * 3/1976 Walton ..... B66D 1/40 60/395
(Continued)

FOREIGN PATENT DOCUMENTS

EP 3 072 845 A1 9/2016
JP 2001-165111 6/2001
(Continued)

OTHER PUBLICATIONS

Extended European Search Report dated Jul. 10, 2018 in Patent Application No. 18155700.0, 7 pages.

*Primary Examiner* — Michael E Gallion
(74) *Attorney, Agent, or Firm* — Oblon, McClelland, Maier & Neustadt, L.L.P.

(57) ABSTRACT

Disclosed is a winch control apparatus for a crane, which comprises: a first compensation torque value calculation section which calculates, when a hoisting manipulation being input, based on a difference speed between a detected rotational speed and a target speed according to a manipulation amount of the hoisting manipulation, a first compensation torque value for enabling an electric motor to generate a reverse-rotation-preventing torque which is a torque in a hoisting direction and corresponding to the difference speed; and a second compensation torque value calculation section which calculates, when the hoisting manipulation being input, based on a detected load value, a second compensation torque value for enabling the electric motor to generate
(Continued)

a load bearing torque which is a torque in the hoisting direction and necessary for bearing a load of the load value.

7 Claims, 6 Drawing Sheets

(51) Int. Cl.
*B66C 23/62* (2006.01)
*B66D 1/46* (2006.01)

(56) References Cited

U.S. PATENT DOCUMENTS

| | | | | | |
|---|---|---|---|---|---|
| 5,818,185 | A * | 10/1998 | Freitag | B66C 13/26 | 318/432 |
| 5,936,375 | A * | 8/1999 | Enoki | B66C 13/28 | 318/53 |
| 7,063,306 | B2 * | 6/2006 | Sanders | B66D 1/485 | 254/361 |
| 10,087,057 | B2 * | 10/2018 | Kawai | B66D 5/02 | |
| 2016/0289054 | A1 * | 10/2016 | Hiekata | B66D 1/46 | |
| 2017/0043983 | A1 * | 2/2017 | Hiekata | B66C 13/12 | |
| 2017/0066634 | A1 * | 3/2017 | Kawai | B66D 5/02 | |
| 2017/0210606 | A1 * | 7/2017 | Kawai | B60T 8/17 | |

FOREIGN PATENT DOCUMENTS

| | | |
|---|---|---|
| JP | 2002-46985 | 2/2002 |
| JP | 2002-120991 | 4/2002 |
| JP | 2015-98390 | 5/2015 |

* cited by examiner

WINCH CONTROL APPARATUS AND CRANE

TECHNICAL FIELD

The present invention relates to an electric motor-driven winch control apparatus, and a crane equipped with the winch control apparatus.

BACKGROUND ART

Generally, a winch control apparatus for a crane comprises an actuator capable of performing a rotational movement for driving a winch drum, and a brake for braking rotation of the winch drum. The winch control apparatus is configured such that, during stopping of the winch drum, the actuator is stopped, and the brake is activated to restrain movement of the winch drum in rotation directions thereof by a braking force of the brake. The winch control apparatus is also configured such that, when starting a hoisting operation, the braking by the brake is released, and, in response to the release, the actuator performs a rotational movement in a hoisting direction.

Assume a situation where the hoisting operation is started in a state in which a suspended load is stopped in the air. In this case, just after releasing the braking, a torque corresponding to a load (weight load) from the suspended load will be suddenly applied to the actuator. In particular, when the load from the suspended load is large, the actuator can fail to resist the suddenly-applied torque, thereby leading to occurrence of a reverse rotation phenomenon that the actuator is temporarily rotated reversely in an unwinding direction of a wire rope (lowering direction).

As a means to avoid such temporary falling of the suspended load due to the reverse rotation phenomenon of the actuator, there is a technique disclosed in JP 2001-165111A. Specifically, the JP 2001-165111A discloses a control apparatus for a hydraulically-driven winch comprising a reverse rotation prevention means operable, when switching a rotation direction switching valve to a hoisting position, to immobilize an lowering-directional rotation of a drive motor for driving a winch dram, until a drive pressure of the drive motor is boosted to cause the drive motor to start rotating in a hoisting direction. In this control apparatus, the reverse rotation prevention means is composed of a device which comprises a ratchet wheel for immobilizing a rotary shaft of the drive motor, a pawl insertable between adjacent teeth of the ratchet wheel, a cylinder for selectively moving the pawl forwardly and backwardly, and a pilot switching valve for introducing a control pressure into the cylinder.

Further, as a means for a motor-driven winch apparatus to prevent a temporary falling of a suspended load, there is a technique disclosed in JP 2002-46985A. Specifically, the JP 2002-46985A discloses a crane comprising: a suspended load holding torque calculation section for estimating the weight of a suspended load from a torque current and the speed of the suspended load, and calculating a suspended load holding torque based on the estimated weight of the suspended load; a maximum torque calculation section for calculating a maximum torque outputtable by a motor; and a control section for calculating an acceleration torque of the suspended load by subtracting the suspended load holding torque from the maximum torque, and subjecting the motor to acceleration control, based on the calculated acceleration torque.

However, the technique disclosed in the JP 2001-165111A requires adding the aforementioned reverse rotation prevention means to a crane, so that there is a problem of an increase in the number of component, leasing to increase in cost, deterioration in reliability and increase in size of the apparatus.

In the technique disclosed in the JP 2002-46985A, there is a possibility that, due to an estimate error in the estimated weight of the suspended load, the suspended load holding torque is estimated to be smaller than an actual suspended load holding torque. In this regard, the technique disclosed in the JP 2002-46985A is not configured to calculate an additional torque for compensating for such an insufficient torque. Therefore, falling of the suspended load can occur.

SUMMARY OF INVENTION

The present invention is directed to preventing falling of a suspended load just after an input of a hoisting manipulation, even without additionally providing any dedicated device for preventing falling of a suspended load.

According to one aspect of the present invention, there is provided a winch control apparatus for a crane. The winch control apparatus comprises: a winch drum around which a wire rope for suspending a suspended load is wound; an electric motor which drives the winch drum in a hoisting direction and a lowering direction; a rotational speed detection section which detects a rotational speed of the electric motor; a manipulation unit to which a hoisting manipulation for driving the winch drum in the hoisting direction is input; a load detection section which detects a load value of the suspended load; a brake which restrains the electric motor from a rotational movement; a brake control section which releases the restraint by the brake, when the hoisting manipulation is input; a first compensation torque value calculation section which calculates, when the hoisting manipulation is input, based on a difference speed between the detected rotational speed and a target speed according to a manipulation amount of the hoisting manipulation, a first compensation torque value for enabling the electric motor to generate a reverse-rotation-preventing torque which is a torque in the hoisting direction corresponding to the difference speed; a second compensation torque value calculation section which calculates, when the hoisting manipulation is input, based on the detected load value, a second compensation torque value for enabling the electric motor to generate a load bearing torque which is a torque in the hoisting direction and necessary for bearing a load of the load value; a command value calculation section which calculates a first command value for making a deviation between the detected rotational speed and the target speed to be zero, and adds the first and second compensation torques to the first command value to thereby calculate a second command value; and an electric power conversion unit which supplies an electric power according to the second command value, to the electric motor.

This control apparatus makes it possible to prevent falling of a suspended load in a lowering direction, just after the input of the hoisting manipulation, even without additionally providing any dedicated device for preventing falling of a suspended load.

DESCRIPTION OF EMBODIMENTS

First Embodiment

Figure 1:
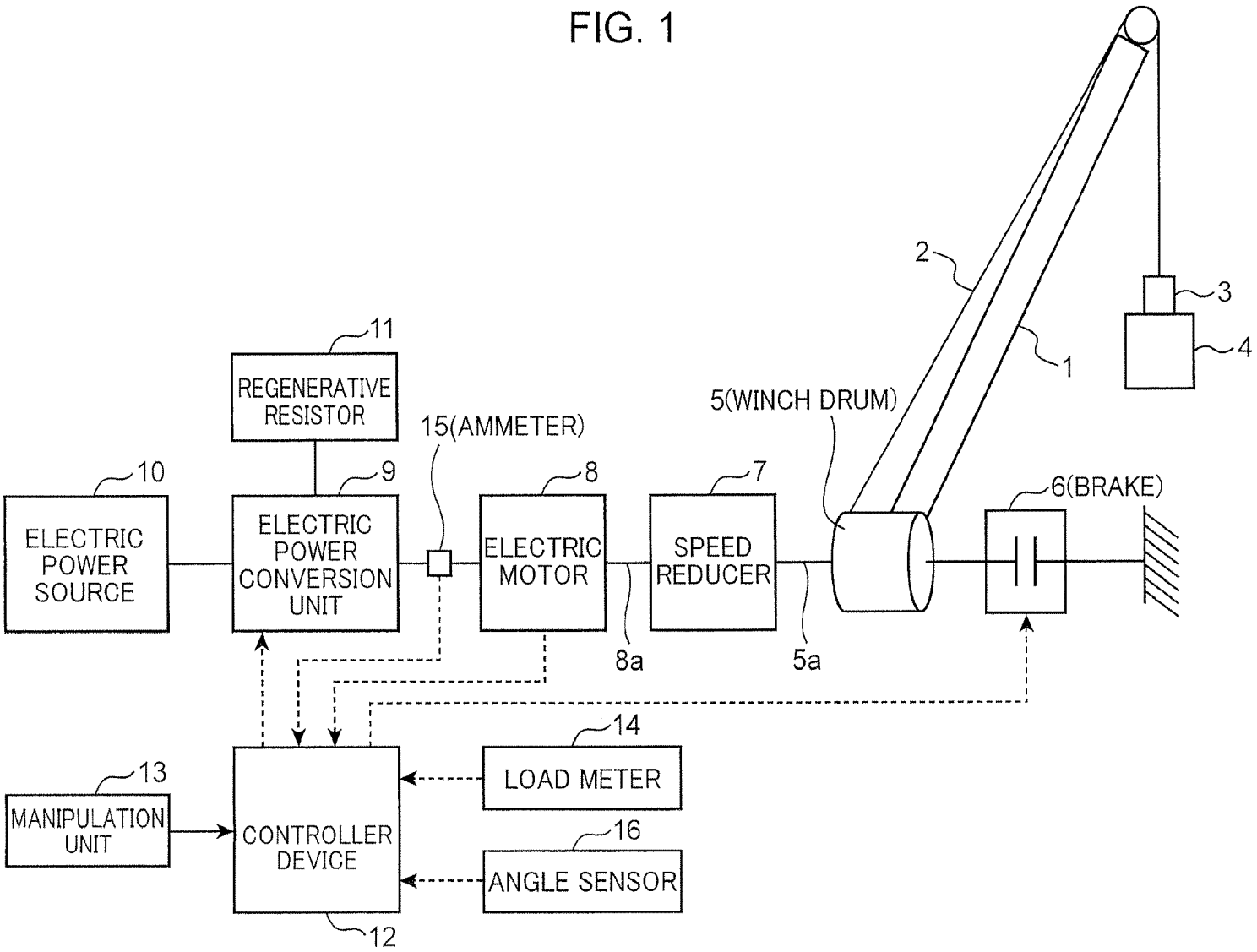
FIG. 1 is a diagram depicting one example of a configuration of a crane employing a winch control apparatus according to a first embodiment of the present invention.

FIG. 1 is a diagram depicting one example of a configuration of a crane employing a winch control apparatus according to a first embodiment of the present invention. The winch control apparatus according to the first embodiment is provided in a crane, and operable to control hoisting and lowering of a suspended load (cargo) 4.

This crane comprises a boom 1 provided on a non-depicted crane body in a raisable and lowerable manner. A hook 3 is suspended from a distal end of the boom via a wire rope 2. The suspended load 4 is suspended through the hook 3. In the following description, the suspended load 4 means an assembly including the hook 3. The winch control apparatus is installed in the non-depicted crane body, and operable to controllably rotate an aftermentioned winch drum 5 to thereby control hoisting and lowering of the suspended load 4 via the wire rope 2.

The winch control apparatus comprises a winch drum 5, a brake 6, a speed reducer 7, an electric motor 8, an electric power conversion unit 9, an electric power source 10, a regenerative resistor 11, a controller device 12, a manipulation unit 13, a load meter 14, an ammeter 15, and an angle sensor 16.

The wire rope 2 is wound around the winch drum 5. The winch drum 5 is connected to a rotary shaft 8*a* of the electric motor 8 via the speed reducer 7, so that it rotatable by torque from the electric motor 8. Further, the brake 6 is connected to a rotary shaft 5*a* of the winch drum 5 to restrain movement of the winch drum 5 in rotation directions thereof.

The brake 6 is configured to selectively restrain movement of the electric motor 8 in rotation directions thereof, and release the restraint, under control of the controller device 12. For example, it is possible to employ, as the brake 6, a band-type or wet disc-type mechanical brake.

The winch drum 5 is configured to be rotated in a hoisting direction which is one of the rotation directions thereof to thereby wind the wire rope 2 therearound to hoist the suspended load 4. The winch drum 5 is also configured to be rotated in a lowering direction opposite to the hoisting direction to thereby unwind the wire rope 2 therefrom to lower the suspended load 4.

The electric motor 8 is configured to be driven by electric power supplied from the electric power source 10 to drive the winch drum 5 in a hoisting direction and a lowering direction, under control of the electric power conversion unit 9. Torque from the electric motor 8 is transmitted to the winch drum 5 through the rotary shaft 8*a*, the speed reducer 7, and the rotary shaft 5*a*, to drive the winch drum 5 in the hoisting direction and a lowering direction.

The electric power conversion unit 9 is configured to convert DC power supplied from the electric power source 10 to AC power, according to a voltage command value output from the controller device 12, and supply the AC power to the electric motor 8 to drive the electric motor 8.

The speed reducer 7 is configured to reduce a rotational speed of the rotary shaft 8*a* of the electric motor 8 at a given speed reduction ratio, and transmit the resulting increased torque to the rotary shaft 5*a* of the winch drum 5.

For example, the electric power source 10 is composed of a battery mounted on the crane. Alternatively, the electric power source 10 may be composed of an external electric power source connected to the electric power conversion unit 9 via a plug-in terminal provided in the crane.

The regenerative resistor 11 is connected to the electric power conversion unit 9 and configured to consume surplus regenerative electric power incapable of being recovered by the electric power source 10, to adjust electric power.

The controller device 12 is composed, for example, of a computer including CPU, ROM and RAM, and a processor such as DSP, and configured to control the electric power conversion unit 9 such that the electric motor 8 is driven at a rotational speed according to a manipulation amount of the manipulation unit 13. Further, the controller device 12 is connected to various sensors such as the load meter 14, the ammeter 15 and the angle sensor 16, and configured to monitor a state of the suspended load 4.

The manipulation unit 13 is configured to enable an operator to input therethrough a manipulation for driving the winch drum 5 in the hoisting direction and a lowering direction. For example, the manipulation unit 13 is composed of a manipulation lever which is tiltable forwardly and rearwardly, or rightwardly and leftwardly, about a neutral position. The manipulation unit 13 is operable, when it is tilted from the neutral position toward one of opposite directions which corresponds to the hoisting direction, to output a manipulation amount corresponding to a tilt amount to the controller device 12, and, when it is tilted from the neutral position toward the other direction which corresponds to the lowering direction, to output a manipulation amount corresponding to a tilt amount to the controller device 12. In this embodiment, the hoisting direction and the lowering direction are distinguished, for example, in such a manner that, when the manipulation unit 13 is manipulated in the lowering direction (lowering manipulation), the manipulation amount takes a minus (negative) value, and, when the manipulation unit 13 is manipulated in the hoisting direction (hoisting manipulation), the manipulation amount takes a plus (positive) value.

The load meter 14 is composed, for example, of a load cell attached to a member for holding a raised/lowered posture of the boom 1 (e.g., a rising-lowering rope), and configured to measure a value of a load applied to the wire rope 2. The controller device 12 is operable to sequentially acquire the load value measured by the load meter 14, and calculate an aftermentioned second compensation torque value from the acquired load value.

The ammeter 15 is provided in an electric power line between the electric power conversion unit 9 and the electric motor 8, and configured to measure a value of current to be supplied from the electric power conversion unit 9 to the electric motor 8. In this embodiment, the ammeter 15 is operable to sequentially measure the value of current to be supplied to the electric motor 8, and sequentially output the measured current value to the controller device 12

The angle sensor 16 is composed, for example, of a resolver or a rotary encoder, and configured to sequentially measure a rotational angle θ of a rotor of the electric motor 8 with respect to a reference position thereof, and sequentially output the measured rotational angle θ to the controller device 12. In this embodiment, opposite rotation directions of the rotor are distinguished, for example, in such a manner that, when the rotor is rotated in the hoisting direction, the rotational angle θ takes a plus (positive) value, and, when the rotor is rotated in the lowering direction, the rotational angle θ takes a minus (negative) value.

Figure 2:
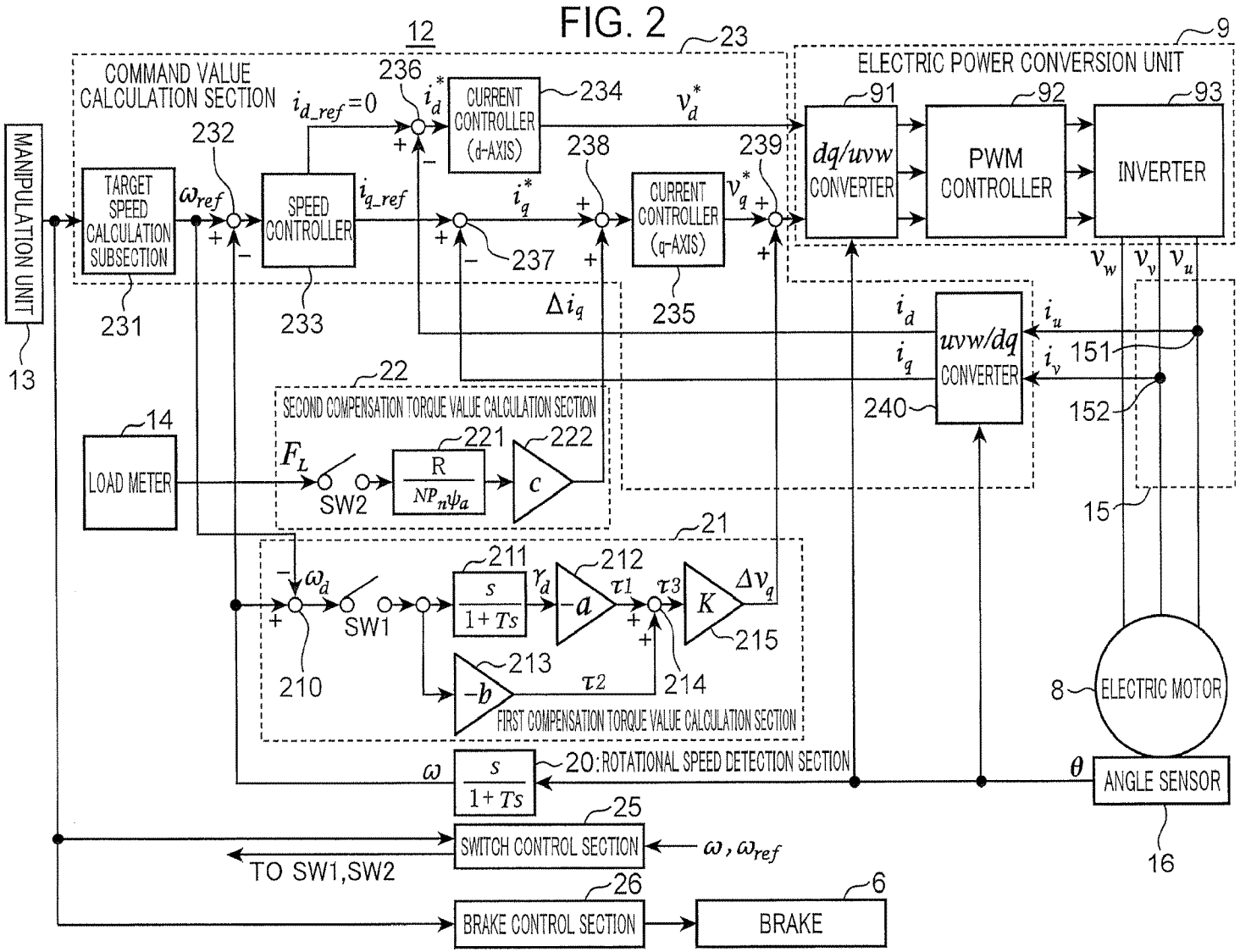
FIG. 2 is a block diagram depicting one example of an internal configuration of a controller device and an electric power conversion unit depicted in FIG. 1.

FIG. 2 is a block diagram depicting one example of an internal configuration of the controller device 12 and the electric power conversion unit 9 depicted in FIG. 1. The controller device 12 comprises a rotational speed detection section 20, a first compensation torque value calculation section 21, a second compensation torque value calculation section 22, a command value calculation section 23, a switch control section 25, and a brake control section 26.

The rotational speed detection section 20 is composed, for example, of a differentiator, and operable to differentiate the rotational angles θ of the electric motor 8 sequentially input from the angle sensor 16 to thereby detect a rotational speed ω of the electric motor 8. In this example, the rotational speed detection section 20 performs approximate differential processing using a transfer function in the following formula (1), in order to numerically perform this differential processing.

$$\frac{s}{1+Ts} \tag{1}$$

In the above formula (1), s: Laplace operator, and T: time constant. For example, the time constant T is be a sufficiently small value satisfying the following relation: T<<1.

The command value calculation section 23 is operable to calculate a first command value for enabling a deviation between deviation between the rotational speed ω and an aftermentioned target speed ωref to become 0, and add aftermentioned first and second compensation torques to the first command value to thereby calculate a second command value. More specifically, the command value calculation section 23 comprises a target speed calculation subsection 231, three subtractors 232, 336, 237, a speed controller 233, two current controllers 234, 235, and two adders 238, 239, and an uvw/dq converter 240.

The target speed calculation subsection 231 is operable to calculate a target speed ωref which is a target rotational speed of the electric motor 8 preliminarily set with respect to each manipulation amount of the hoisting or lowering manipulation input through the manipulation unit 13. It should be noted that this embodiment will hereinafter be described by taking the hoisting manipulation as an example, and description about the lowering manipulation will be omitted. In this example, the target speed calculation subsection 231 is provided with a manipulation characteristic map in which a relationship between the manipulation amount of the hoisting manipulation and the target speed ωref is preliminarily defined. Thus, a target speed ωref according to an input manipulation amount of the hoisting manipulation can be calculated using the manipulation characteristic map. In the manipulation characteristic map, the relationship between the manipulation amount of the hoisting manipulation and the target speed ωref is set such that the target speed ωref gradually increases along with an increase of the manipulation amount of the hoisting manipulation.

The subtractor 232 is operable to subtract the rotational speed ω from the target speed ωref to calculate a speed deviation of the rotational speed ω with respect to the target speed ωref.

The speed controller 233 is operable to receive an input of the speed deviation from the subtractor 232, and calculate target current values id_ref, iq_ref for enabling this speed deviation to become 0. For example, the speed controller 233 may be configured to calculate a torque command value for enabling the speed deviation to become 0, using PI (Proportional-Integral) control, and calculate predefined values with respect to the calculated torque command value, as the target current values id_ref, iq_ref. It should be noted that this is just one example, and the torque command value may be calculated using PID (Proportional-Integral-Derivative) control or P control. The target current value id_ref is a d-axis current target value, and the target current value iq_ref is a q-axis current target value.

In the example depicted in FIG. 2, a surface permanent magnet synchronous motor (SPMSM) is employed as the electric motor 8. Thus, in order to minimize d-axis current having no contribution to torque, the target current value id_ref is set to 0. However, this is just one example, and the target current value id_ref needs not be set to 0. For example, in the case where weak flux control is performed, the target current value id_ref is not necessarily set to 0. Similarly, for example, in the case where an interior permanent magnet synchronous motor (IPMSM) is employed as the electric motor 8, wherein maximum torque control is performed, the target current value id_ref is not necessarily set to 0.

The subtractor 236 (one example of "first subtractor") is operable to subtract an aftermentioned d-axis current value id from the target current value id_ref to calculate a d-axis current command value id*.

The current controller 234 (one example of "first current controller") is operable to calculate a d-axis voltage command value vd*, from the current command value id*. For example, the current controller 234 may employ PI control to calculate the d-axis voltage command value vd* so as to enable the current command value id* to become 0. However, this is just one example, and the current controller 234 may employ PID control or P control to calculate the voltage command value vd*.

The subtractor 237 (one example of "second subtractor") is operable to subtract an aftermentioned q-axis current value iq from the target current value iq_ref to calculate a q-axis current command value iq*. The adder 238 (one example of "first adder") is operable to add the aftermentioned second compensation torque value Δiq to the current command value iq* calculated in the subtractor 237 to calculate a current command value (iq*+Δiq).

The current controller 235 (one example of "second current controller") is operable to calculate a q-axis voltage command value vq*, from the current command value (iq*+Δiq) calculated in the adder 238. For example, the current controller 235 may employ PI control to calculate the voltage command value vq* so as to enable the current command value (iq*+Δiq) to become 0. However, this is just one example, and the current controller 235 may employ PID control or P control to calculate the voltage command value vq*.

The voltage command value vd* is a command value for controlling a magnetic field of the electric motor 8, and the voltage command value vq* is a command value for controlling a torque of the electric motor 8.

The adder 239 (one example of "second adder") is operable to add the aftermentioned first compensation torque value Δvq to the voltage command value vq* to calculate a voltage command value (vq*+Δvq). The current command value iq* and the voltage command value vq* are equivalent to one example of "first command value", and the voltage command value (vq*+Δvq) is equivalent to one example of a q-axis component of "second command value".

The uvw/dq converter 240 is operable to transform coordinates of v-phase current values measured by aftermentioned current sensors 151, 152 to calculate a d-axis current value id, and a q-axis current value iq. The current values id, iq are output, respectively, to the subtractors 236, 237.

The ammeter 15 comprises two current sensors 151, 152. Each of the current sensors 151, 152 is composed, for example, of a Hall-effect current sensor utilizing a Hall element, and operable to detect respectively a v-phase current and an u-phase current supplied from an aftermentioned inverter 93 to the electric motor 8.

The electric power conversion unit 9 comprises a dq/uvw converter 91, a PWM controller 92, and an inverter 93, and is operable to supply an electric power according to the voltage command value vd* and the voltage command value (vq*+Δvq) calculated in the command value calculation section 23.

The dq/uvw converter 91 is operable to transform coordinates of the voltage command value vd* and the voltage command value (vq*+Δvq) to generate u-phase, v-phase and w-phase voltage command values, and output them to the PWM controller 92.

The PWM controller 92 is operable to generate u-phase, v-phase and w-phase PWM signals, respectively, from the v-phase and w-phase voltage command values calculated in the dq/uvw converter 91, and output them to the inverter 93.

The inverter 93 is composed, for example, of a three-phase inverter comprising total six switching elements, wherein three sets of the two switching elements are assigned, respectively, to the u-phase, v-phase and w-phase PWM signals. The inverter 93 is operable to turn on and off each of the u-phase, v-phase and w-phase switching elements in accordance with the u-phase, v-phase and w-phase PWM signals supplied from the PWM controller 92 to thereby supply u-phase, v-phase and w-phase AC power to the electric motor 8.

The electric motor 8 is composed, for example, of a brushless motor such as a surface permanent magnet synchronous motor or an interior permanent magnet synchronous motor (IPMSM), and configured to be driven in accordance with the three-phase, u-phase, v-phase and w-phase, AC power output from the inverter 93. By driving the electric motor 8 in this way, the winch drum 5 is rotated to perform hoisting and lowering of the suspended load 4.

The above is the basic configurations of the controller device 12 and the electric power conversion unit 9, wherein the electric motor 8 is subjected to vector control to enable the rotational speed ω to follow the target speed ωref.

The first compensation torque value calculation section 21 is operable, when a hoisting manipulation is input through the manipulation unit 13, to calculate, based on a difference speed cod between the rotational speed ω and the target speed ωref, a first compensation torque value Δvq for enabling the electric motor to generate a reverse-rotation-preventing torque which is a torque oriented in the hoisting direction and corresponding to the difference speed ωd.

More specifically, the first compensation torque value calculation section 21 comprises a subtractor 210, a switch SW1, a differentiator 211, three amplifiers 212, 213, 215, and an adder 214.

The subtractor 210 is operable to subtract the target speed ωref from the rotational speed ω to calculate a difference speed ωd.

The switch SW1 is configured to be turned on and off under control of the switch control section 25. The reverse-rotation-preventing torque may be generated by the electric motor 8, in a period after the input of the hoisting manipulation through until the rotational speed ω reaches the target speed ωref. This is because falling of the suspended load 4 is less likely to occur in a state where the rotational speed ω follows the target speed ωref, and therefore if the reverse-rotation-preventing torque is generated in such a state, the electric motor 8 will be obliged to generate uselessly torque. Thus, under control of the switch control section 25, the switch SW1 is turned on when the hoisting manipulation is input, and the following relation is satisfied: (target speed ωref−rotational speed ω)>0 (difference speed ωd<0).

The differentiator 211 is operable to calculate a differential acceleration γd obtained by differentiating the difference speed ωd, for example, using the transfer function represented by the formula (1). The amplifier 212 is operable to multiply the differential acceleration γd by a gain (control parameter): −a, to calculate a torque component τ1 (=−a×γd). The amplifier 212 is operable to multiply the difference speed ωd by a gain (control parameter): −b, to calculate a torque component τ2 (=−b×ωd). The adder 214 is operable to add the torque component τ1 and the torque component τ2 to calculate a reverse-rotation-preventing torque τ3. As above, in the amplifiers 212, 213, their gains are −a, and −b, each having minus sign. This is in consideration that the switch SW1 is turned on in a period where the difference speed ωd has a minus value. Thus, the reverse-rotation-preventing torque τ3 has a plus value, which means that it is oriented in the hoisting direction.

In the winch control apparatus, a motion equation of rotating system is expressed, for example, as $\tau=J\times\omega'+c\cdot\omega$, where: τ denotes torque; ω denotes rotational speed (angular speed); ω' denotes differentiation of ω (angular acceleration); J denotes a synthesized value of inertia moments of the winch drum 5, the speed reducer 7 and the electric motor 8; and c denotes a synthesized value of viscosity coefficients in the winch control apparatus.

The torque component τ1 (=−a×γd) calculated in the differentiator 211 and the amplifier 212 is equivalent to J×ω' in the above motion equation, and the torque component τ2 (=−b×ωd) is equivalent to c·ω in the above motion equation, wherein each has a value equivalent to torque. Thus, it is only necessary to employ, as the magnitude of the gain: −a, a value determined, for example, by taking into account a synthesized value of inertia moments of the winch drum 5, the speed reducer 7 and the electric motor 8. Further, it is only necessary to employ, as the magnitude of the gain: −b, a value determined, for example, by taking into account a synthesized value of viscosity coefficients in the winch control apparatus. The reverse-rotation-preventing torque τ3 is obtained by assigning the difference speed ωd to ω in the above motion equation, and has a plus value, which indicates that the reverse-rotation-preventing torque τ3 is oriented in the hoisting direction and equivalent to the difference speed ωd.

The amplifier 215 is operable to multiply the reverse-rotation-preventing torque τ3 by a conversion coefficient K to thereby convert the reverse-rotation-preventing torque τ3 into voltage to calculate the first compensation torque value Δvq. For example, the conversion coefficient K can be expressed as the following formula (2).

$$K = \frac{R_a}{P_n\left\{\psi_a + \frac{1}{2}(L_q - L_d)i_d\right\}} \tag{2}$$

In the above formula, Ra: phase resistance of the electric motor 8, Pn: pole-pair number of the electric motor 8, ψa: interlinkage magnetic flux of permanent magnets of the electric motor 8, Ld: d-axis inductance component of the electric motor 8, Lq: q-axis inductance component of the electric motor 8, and id: d-axis current value calculated in the uvw/dq converter 240.

In this example, the formula (2) is employed as the conversion coefficient K. However, this is just one example, and any other mathematical formula may be employed as long as it is capable of converting the reverse-rotation-preventing torque τ3 into a voltage command value. For example, a mathematical formula preliminarily determined depending on a type of the electric motor 8 may be employed as the conversion coefficient K.

The second compensation torque value calculation section 22 is operable, when a hoisting manipulation is input through the manipulation unit 13, to calculate, based on a load value FL detected by the load meter 14, a second compensation torque value for enabling the electric motor 8 to generate a load bearing torque which is a torque oriented in the hoisting direction and necessary for bearing a load of the load value FL.

More specifically, the second compensation torque value calculation section 22 comprises a switch SW2, a load converter 221, and an amplifier 222.

The switch SW2 is configured to be turned on and off under control of the switch control section 25. The load bearing torque may be generated in a period where the hoisting manipulation is input. This is because if none of the hoisting manipulation and the lowering operation is input, the electric motor 8 is restrained by the brake 6. Thus, under control of the switch control section 25, the switch SW2 is turned on when the hoisting manipulation is input through the manipulation unit 13. When the rotational speed ω reaches the target speed ωref, the calculation of the first compensation torque value is stopped, and, on the other hand, the calculation of the second compensation torque value is successively performed. The reason is to prevent falling of the suspended load 4 which would otherwise occur when the manipulation amount is rapidly changed during the hoisting manipulation.

The load converter 221 is operable to multiply the load value FL by a conversion coefficient represented by the following formula (3) to calculate a torque current value for enabling the electric motor 8 to generate the load bearing torque.

$$\frac{R}{NP_n\psi_a} \tag{3}$$

In the above formula, N: speed reduction ratio of the speed reducer 7, R: radius of the winch drum 5, Pn: pole-pair number, and ψa: interlinkage magnetic flux of permanent magnets of the electric motor 8.

In this example, the formula (3) is employed as the conversion coefficient K. However, this is just one example, and any other mathematical formula may be employed as long as it is capable of converting the load value FL into a torque current value. For example, it is possible to employ a conversion coefficient preliminarily determined depending on a type of the electric motor 8.

The amplifier 222 is operable to multiply the torque current value calculated in the load converter 221 by a gain c to calculate the second compensation torque value Δiq. The gain c is set to satisfy the following relation: c<1.

Meanwhile, due to influences of transitional swing of the suspended load 4 occurring just after start of the hoisting operation, and/or detection accuracy of the load meter 14, the load value FL detected by the load meter 14 is likely to have a value greater than an actual load value of the suspended load 4. In this case, the second compensation torque value Δiq becomes greater than the value necessary for bearing the suspending load 4, possibly leading to occurrence of a phenomenon that the suspended load 4 is temporarily moved in the hoisting direction just after start of the hoisting operation, so-called "jump-up phenomenon" of the suspended load 4.

Therefore, in order to subtract, from the torque current value calculated by the load converter 221, an assumed value which is an excess part of the load value FL with respect to an actual load value of the suspended load 4, caused by influences of transitional swing of the suspended load 4 and/or detection accuracy of the load meter 14, or a value obtained by adding a certain margin to the assumed value, the amplifier 222 is operable to multiply this torque current value by the gain c which is less than 1. This makes it possible to prevent the jump-up phenomenon of the suspended load 4.

For example, in the case where a detection error of the load meter 14 is several %, in order to subtract a value corresponding to 20% which is twice or more the detection error, from the torque current value calculated by the load converter 221, the amplifier 222 is operable to employ 0.8 as the gain c. This makes it possible to prevent the jump-up phenomenon of the suspended load 4. The second compensation torque value Δiq calculated in the amplifier 222 is added to the current command value iq* through the adder 238, and the resulting command value is input into the current controller 235. As a result, a load bearing torque corresponding to the second compensation torque value is generated in the electric motor 8.

Contrariwise, due to influences of transitional swing of the suspended load 4 and/or detection accuracy of the load meter 14, the load value FL detected by the load meter 14 is likely to have a value less than an actual load value of the suspended load 4. In this case, a load bearing torque generated by the electric motor 8 in accordance with the second compensation torque value becomes less than a torque necessary for bearing the actual load value, possibly leading to occurrence of slight falling of the suspended load 4. However, in this embodiment, the reverse-rotation-preventing torque according to the first compensation torque value is generated in the electric motor 8, so that it is possible to prevent such falling.

The switch control section 25 is operable to turn on and off each of the switches SW1, SW2, based on the rotational speed ω calculated in the rotational speed detection section 20, the target speed ωref calculated in the target speed calculation subsection 231, and the manipulation amount output from the manipulation unit 13. More specifically, the switch control section 25 is operable, when the hoisting manipulation is input, and the following relation is satisfied: (target speed ωref−rotational speed ω)>0, to turn on the switch SW1. On the other hand, the switch control section 25 is operable, when no hoisting manipulation is input, or the following relation is satisfied: (target speed ωref−rotational speed ω)≤0, to turn off the switch SW1.

Further, the switch control section 25 is operable, when the manipulation amount indicates the hoisting manipulation, to turn on the switch SW2. On the other hand, the switch control section 25 is operable, when the manipulation amount does not indicate the hoisting manipulation, to turn off the switch SW2. In this regard, the switch control section 25 may be configured to determine that the hoisting manipulation is input, when detecting that the manipulation amount of the hoisting manipulation is greater than 0, or that the target speed ωref is greater than 0.

The brake control section 26 is operable, when the hoisting manipulation or lowering manipulation is input through the manipulation unit 13, to release restraint of the electric motor 8 by the brake 6. On the other hand, the brake control section 26 is operable, when the manipulation unit 13 is positioned at the neutral position, to control the brake 6 to restrain movement of the electric motor 8 in the rotation directions thereof.

Figure 3:
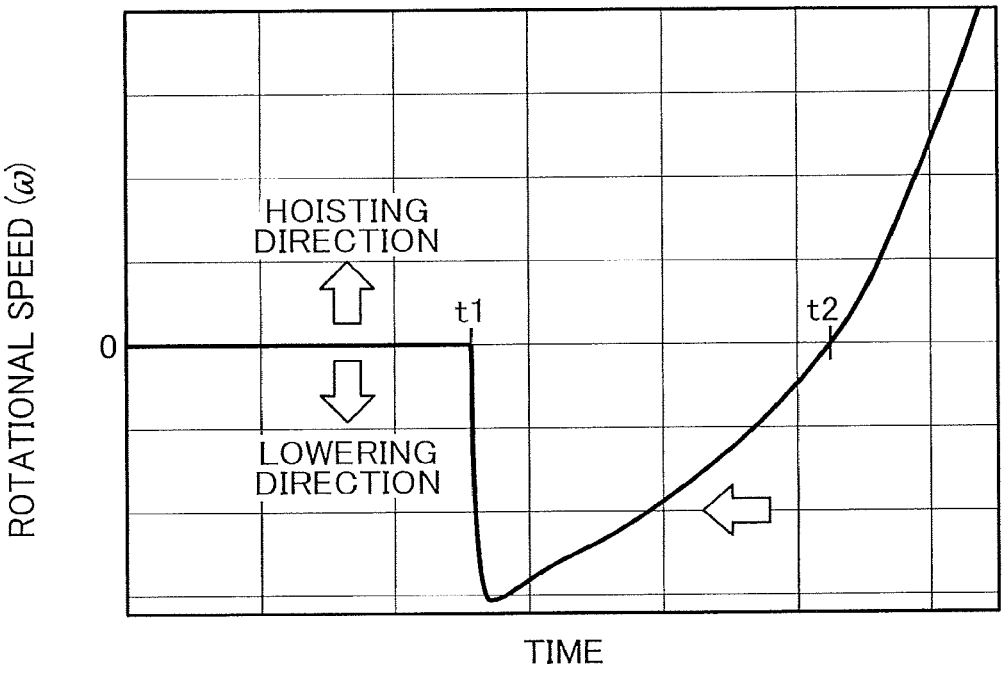
FIG. 3 is a graph presenting a temporal change in rotational speed at start of hoisting manipulation, in the case of executing a simulation regarding a process of subjecting an electric motor to speed control without calculating first and second compensation torque values.

FIG. 3 is a graph presenting a temporal change in the rotational speed ω at start of hoisting manipulation, in the case of executing a simulation regarding a process of subjecting the electric motor 8 to speed control without calculating the first and second compensation torque values. In FIG. 3, the vertical axis represents the rotational speed ω, and the horizontal axis represents time. At time t1, the hoisting manipulation is input, and the brake 6 is released. In this simulation, a conventional speed control of enabling a speed deviation between the target speed ωref and the rotational speed ω to become 0, so that, at the start of the hoisting manipulation, the rotational speed ω cannot immediately follow the target speed ωref. Thus, as seen in FIG. 3, the electric motor 8 cannot bear a load torque of the suspended load 4 imposed in the lowering direction, so that the rotational speed ω is rapidly increased from 0 toward a minus direction (lowering direction), i.e., the suspended load 4 falls. Then, at time t2, the rotational speed ω is increased beyond 0, and falling of the suspended load 4 is stopped. However, as seen in FIG. 3, due to a relatively large increase of the rotational speed ω in the lowering direction at the time t2, a period of time between the time t1 and the time t2 when the falling is stopped is relatively long.

Figure 4:
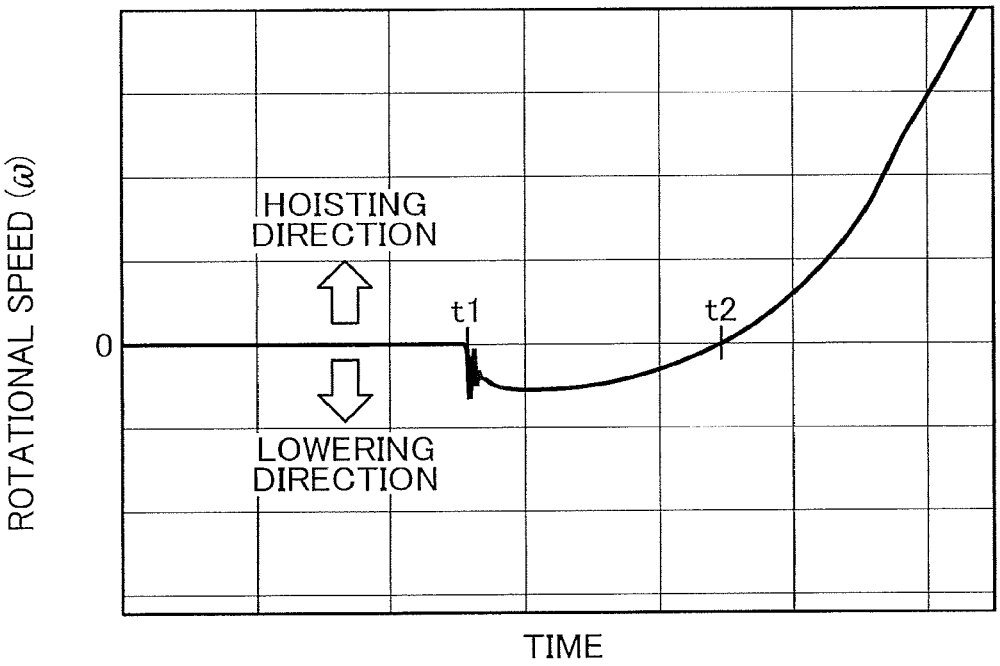
FIG. 4 is a graph presenting a temporal change in rotational speed at the start of the hoisting manipulation, in the case of executing a simulation regarding a process of subjecting the electric motor to speed control while calculating only the first compensation torque value.

FIG. 4 is a graph presenting a temporal change in rotational speed at the start of the hoisting manipulation, in the case of executing a simulation regarding a process of subjecting the electric motor 8 to speed control while calculating only the first compensation torque value. In FIG. 4, the vertical and horizontal axes are the same as those in FIG. 3. At the time t1, the hoisting manipulation is input, and the brake 6 is released. In this simulation, a reverse-rotation-preventing torque corresponding to the first compensation torque value is added to the electric motor 8 at the start of the hoisting operation, so that the characteristic of the rotational speed ω is improved as compared to that in FIG. 3, in terms of an increase of the rotational speed ω in the minus direction (lowering direction). However, the first compensation torque value is calculated after detection of the rotational speed ω. This means that the reverse-rotation-preventing torque is generated in the electric motor 8 only after the suspended load 4 falls. Thus, as seen in FIG. 4, the electric motor 8 cannot bear a load torque of the suspended load 4 imposed in the lowering direction at the start of the hoisting manipulation, so that the suspended load 4 somewhat falls. In this connection, it is possible to further suppress falling of the suspended load 4 by increasing the absolute values of the gains (i.e., −a, and −b) to thereby increase the reverse-rotation-preventing torque. However, an excessive increase in the absolute values of the gains (i.e., −a, and −b) causes overshooting of the rotational speed ω with respect to the target speed ωref, resulting in occurrence of oscillation of the rotational speed ω, as depicted in FIG. 4. In this case, manipulation performance during hoisting operation is deteriorated.

Figure 5:
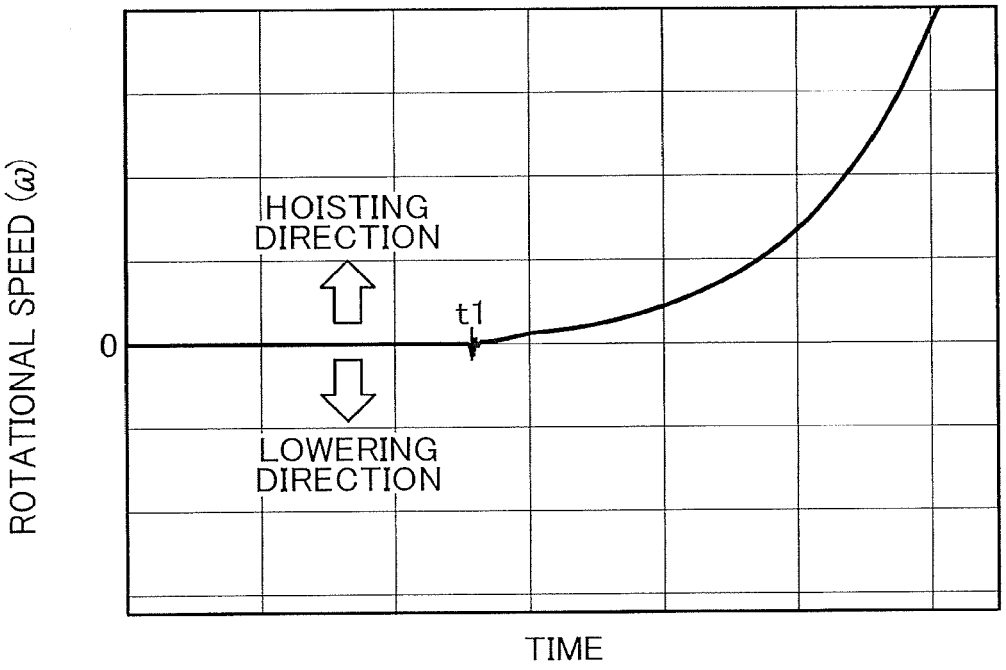
FIG. 5 is a graph presenting a temporal change in rotational speed at the start of the hoisting manipulation, in the case of executing a simulation regarding a process of subjecting the electric motor to speed control while calculating the first and second compensation torque values.

FIG. 5 is a graph presenting a temporal change in rotational speed at the start of the hoisting manipulation, in the case of executing a simulation regarding a process of subjecting the electric motor 8 to speed control while calculating the first and second compensation torque values. In FIG. 5, the vertical and horizontal axes are the same as those in FIG. 3. In this simulation, at the start of the hoisting manipulation, in addition to the reverse-rotation-preventing torque corresponding to the first compensation torque value, a load bearing torque corresponding to the second compensation torque value is generated in the electric motor 8. In this case, the second compensation torque value is calculated just after the hoisting manipulation is input, so that the load bearing torque is generated in the electric motor 8 immediately after the hoisting operation is started. Thus, a shortfall in the reverse-rotation-preventing torque for bearing a load torque of the suspended load 4 is compensated by the load hearing torque. As a result, as seen in FIG. 5, no increase of the rotational speed ω in the minus direction occurs at the time t1, i.e., the rotational speed ω can desirably follow the target speed ωref. Thus, it becomes possible to prevent falling of the suspended load 4. In addition, a shortfall in the reverse-rotation-preventing torque is compensated by the load bearing torque, so that it becomes possible to prevent falling of the suspended load 4 even when the absolute values of the gains (i.e., −a, and −b) used for calculation of the first compensation torque value are set to relatively small value. Therefore, it becomes possible to suppress oscillation of the rotational speed ω at start of hoisting operation.

As above, in the winch control apparatus according to the first embodiment, upon input of the hoisting manipulation, the reverse-rotation-preventing torque and the load bearing torque are generated in the electric motor 8. This makes it possible to prevent falling of the suspended load 4 which would otherwise occur during the input of the hoisting manipulation, without providing any dedicated device for preventing falling of the suspended load 4.

Second Embodiment

A winch control apparatus according to a second embodiment of the present invention is characterized in that a load value of a suspended load 4 is calculated without using a load meter 14. In the second embodiment, the same element or component as that in the first embodiment is assigned with the same reference sign, and description thereof will be omitted.

Figure 6:
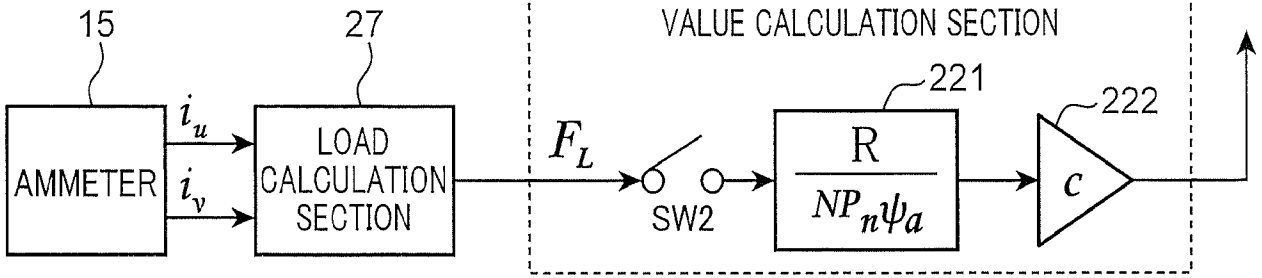
FIG. 6 is a block diagram depicting a configuration centering on a second compensation torque value calculation section, in a winch control device according to a second embodiment of the present invention.

FIG. 6 is a block diagram depicting a configuration centering on a second compensation torque value calculation section, in the winch control device according to the second embodiment. In the second embodiment, as depicted in FIG. 6, a load calculation section 27 is provided, in place of the load meter 14 depicted in FIG. 2.

The load calculation section 27 is operable to transform coordinates of current values iu, iv measured by an ammeter 15 to calculate current values id, iq. Then, the load calculation section 27 is operable to calculate a load value FL using the following formula (4).

For example, it is possible to employ, as the current values iu, iv for use in calculation of the load value FL, values measured by the ammeter 15 before input of a hoisting manipulation and just before stopping an electric motor 8.

As mentioned in connection with the first embodiment, the winch control apparatus employs a configuration in which when the hoisting manipulation is input, restraint of the electric motor 8 by a brake 6 is released. Thus, just before input of the hoisting manipulation, the electric motor 8 is restrained by the brake 6, and thus each of the current values iu, iv measured by the ammeter 15 is 0. For this reason, the load value FL at a timing just before input of the hoisting manipulation cannot be calculated by the current values iu, iv measured just before input of the hoisting manipulation.

Therefore, in this embodiment, the load calculation section 27 is operable to transform coordinates of the current values iu, iv measured by the ammeter 15 before input of the hoisting manipulation and just before stopping of the electric motor 8 to calculate the current values iq, id, and input them into the formula (4) to calculate the load value FL.

$$F_L = P_n\left\{\psi_a I_q + \frac{1}{2}(L_q - L_d)I_d I_q\right\}\Big/ R \tag{4}$$

In the above formula, Pn: pole-pair number of the electric motor 8, ψa: interlinkage magnetic flux of permanent magnets of the electric motor 8, Ld: d-axis inductance component of the electric motor 8, Lq: q-axis inductance component of the electric motor 8, id: d-axis current value, iq: q-axis current value, and R: radius of a winch drum 5.

In the formula (4), the numerator represents a torque estimate value of the electric motor 8. Thus, the load value FL can be obtained by dividing the numerator by the radius R of the winch drum 5.

The second compensation torque value calculation section 22 is operable to calculate the second compensation torque value using the calculated load value FL, as with the first embodiment.

As above, in the winch control apparatus according to the second embodiment, the load value FL is calculated from the current values calculated in the ammeter 15. A wire rope 2 largely moves during hoisting or lowering operation, so that it is difficult to attach the load meter to the wire rope. For this reason, the load meter 14 as described in the first embodiment is generally attached to a rising-lowering rope or the like. Thus, there is a possibility that a load value measured by the load meter 14 does not accurately indicate an actual load value.

The electric motor 8 is generally configured to generate a torque necessary for bearing a load torque of the suspended load 4, wherein this torque is determined by a current supplied to the electric motor 8. Thus, a load value calculated from current values measured by the ammeter 15 can be considered to more directly indicate an actual load value, as compared to a load value measured by the load meter 14. Therefore, this embodiment makes it possible to accurately detect the load value.

It should be noted that the present invention is not limited to the above embodiments, but the following modifications may be employed.

(1) In the first and second embodiments, the first compensation torque value is added to the voltage command value vq*. However, the present invention is not limited thereto, but the first compensation torque value may be added to the current command value iq*. In this case, the first compensation torque value calculation section 21 may be configured to calculate the first compensation torque value using a conversion coefficient for converting the reverse-rotation-preventing torque τ3 into current, in place of the conversion coefficient K represented by the formula (2).

(2) In the first and second embodiments, the second compensation torque value is added to the current command value iq*. However, the present invention is not limited thereto, but the second compensation torque value may be added to the voltage command value vq*. In this case, the second compensation torque value calculation section 22 may be configured to calculate the second compensation torque value using a conversion coefficient for converting the load value FL into voltage, in place of the conversion coefficient represented by the formula (3).

(3) In the first and second embodiments, the electric motor 8 is controlled by vector control using d-axis and q-axis. Alternatively, the electric motor 8 may be controlled by a feedback control simply configured to enable a deviation between the target speed ωref and the rotational speed ω to become 0, without using d-axis and q-axis.

(4) In FIG. 2, the first compensation torque value calculation section 21 calculates both of the torque component τ1 and the torque component τ2. Alternatively, the first compensation torque value calculation section 21 may be configured to calculate either one of them.

Outline of Embodiments

According to one aspect of this disclosure, there is provided a winch control apparatus for a cane. The winch control apparatus comprises: a winch drum around which a wire rope for suspending a suspended load is wound; an electric motor which driving the winch drum in a hoisting direction and a lowering direction; a rotational speed detection section which detects a rotational speed of the electric motor; a manipulation unit to which a hoisting manipulation for driving the winch drum in the hoisting direction is input; a load detection section which detects a load value of the suspended load; a brake which restrains the electric motor from a rotational movement; a brake control section which releases the restraint by the brake, when the hoisting manipulation is input; a first compensation torque value calculation section which calculates, when the hoisting manipulation is input, based on a difference speed between the detected rotational speed and a target speed according to a manipulation amount of the hoisting manipulation, a first compensation torque value for enabling the electric motor to generate a reverse-rotation-preventing torque which is a torque in the hoisting direction corresponding to the difference speed; a second compensation torque value calculation section which calculates, when the hoisting manipulation is input, based on the detected load value, a second compensation torque value for enabling the electric motor to generate a load bearing torque which is a torque in the hoisting direction and necessary for bearing a load of the load value; a command value calculation section which calculates a first command value for making a deviation between the detected rotational speed and the target speed to be zero, and adds the first and second compensation torques to the first command value to thereby calculate a second command value; and an electric power conversion unit which supplies an electric power according to the second command value, to the electric motor.

In the winch control apparatus according to this aspect, upon input of the hoisting manipulation, based on a difference speed between the rotational speed of the electric motor and the a target speed, a first compensation torque value for enabling the electric motor to generate a reverse-rotation-preventing torque which is a torque oriented in the hoisting direction and corresponding to the difference speed is calculated, and added to to the first command value. Thus, at start of hoisting operation, the reverse-rotation-preventing torque is generated in the electric motor to compensate for a shortfall in speed control-based torque for bearing a load torque.

However, the first compensation torque value is calculated after detection of the rotational speed of the electric motor, so that the reverse-rotation-preventing torque cannot sufficiently prevent falling of the suspended load just after input of the hoisting manipulation.

Therefore, in this aspect, upon input of the hoisting manipulation, based in a load value of the suspended load, a second compensation torque value for enabling the electric motor to generate a load bearing torque which is a torque oriented in the hoisting direction and necessary for bearing a load of the load value is calculated and added to the first command value. In this case, the second compensation torque value is calculated just after input of the hoisting manipulation, so that the load bearing torque is generated in the electric motor immediately after start of the hoisting operation, and is therefore capable of compensating for a shortfall in the reverse-rotation-preventing torque so as to prevent falling of the suspended load.

Further, in the case where the load detection section detects a load value less than an actual load value of the suspended load, the second compensation torque value is enough to ensure a torque for bearing a load torque of the suspended load, thereby possibly leading to occurrence of falling of the suspended load. In the winch control apparatus according to this aspect, in addition to the load bearing torque according to the second compensation torque value, the reverse-rotation-preventing torque according to the first compensation torque value is imparted to the electric motor 8. This makes it possible to compensate for a shortfall in the load bearing torque for bearing a load torque, so as to prevent falling of the suspended load.

In the winch control apparatus according to this aspect, the first and second compensation torque values are calculated using the rotational speed detection section and the load detection section, so that it is not necessary to additionally provide a dedicated device such as the reverse rotation prevention means disclosed in the JP 2001-165111A. Therefore, the winch control apparatus according to this aspect is capable of preventing falling of the suspended load just after input of the hoisting manipulation, without providing such a dedicated device.

In addition, the winch control apparatus according to this aspect is configured such that when the hoisting manipulation is input, the brake is released. This makes it possible to prevent wear of the brake.

Preferably, in the winch control apparatus according to this aspect, the first compensation torque value calculation section calculates, when the hoisting manipulation is input, until the detected rotational speed reaches the target speed, the first compensation torque value using at least one of the difference speed and a differential acceleration obtained by differentiating the difference speed.

According to this feature, the first compensation torque value is calculated using at least one of the difference speed, and a differential acceleration obtained by differentiating the difference speed. This enables the first compensation torque value to accurately indicate a torque oriented in the hoisting direction and corresponding to the difference speed. Further, according to this feature, when the rotational speed of the electric motor reaches the target speed, the generation of the reverse-rotation-preventing torque is stopped, so that it is possible to prevent an unnecessary torque from being applied to the suspended load in a state in which the rotational speed follows the target speed.

Preferably, in the winch control apparatus according to this aspect, the load detection section is formed of a load meter for measuring the load value of the suspended load.

According to this feature, the load value of the suspended load is measured by the load meter, so that it is possible to obtain the load value of the suspended load in a direct manner.

Preferably, in the winch control apparatus according to this aspect, the load detection section comprises an ammeter for measuring a current value which is a value of current to be input into the electric motor, and a load calculation section for calculating the load value of the suspended load from the measured current value.

According to this feature, the load value of the suspended load is measured by using a current value to be supplied to the electric motor, so that it is possible to more accurately calculate the load value of the suspended load, as compared to the case where the load value is measured by using a load meter which has difficulty in being directly attached to a wire rope.

Preferably, in the winch control apparatus according to this aspect, the second compensation torque value calculation section calculates, as the second compensation torque value, a value which is less, by a given value, than a torque corresponding to the load value detected by the load detection section.

Due to influences of transitional swing of the suspended load occurring just after start of hoisting operation, and/or detection accuracy of the load detection section, the load value of the suspended load detected by the load detection section is likely to have a value greater than an actual load value of the suspended load. In this case, the second compensation torque value becomes greater than a value necessary for bearing the suspending load, possibly leading to occurrence of a phenomenon that the suspended load is temporarily moved in the hoisting direction just after start of the hoisting operation, so-called "jump-up phenomenon" of the suspended load. Therefore, according to this feature, a value which is less, by a given value, than a torque corresponding to the load value detected by the load detection section is calculated as the second compensation torque value. This makes it possible to prevent the jump-up phenomenon of the suspended load, even when the load detection section detects a load value greater than an actual load value of the suspended load.

Preferably, in the winch control apparatus according to this aspect, the command value calculation section comprises: a speed controller for calculating a d-axis current target value and a q-axis current target value for making the deviation between the detected rotational speed and the target speed to become zero; a first subtractor for calculating, as a d-axis current command value, a deviation between a d-axis current value of a current to be supplied to the electric motor, and the d-axis current target value; a first current controller for calculating a d-axis voltage command value for making the d-axis current command value to become zero; a second subtractor for calculating, as a q-axis current command value, a deviation between a q-axis current value of the current to be supplied to the electric motor, and the q-axis current target value; a first adder for adding the second compensation torque value to the q-axis current command value; a second current controller for calculating a q-axis voltage command value for enabling the added value obtained by the first adder to become zero; and a second adder for adding the first compensation torque value to the q-axis voltage command value.

According to this feature, the second compensation torque is added to the q-axis current command value for controlling torque of the electric motor, and the first compensation torque is added to the q-axis voltage command value for controlling torque of the electric motor, so that it is possible to more reliably prevent falling of the suspended load.

A crane may be constricted using the above winch control apparatus. In this case, the crane can obtain the same advantageous effects as those described above in the crane.

This application is based on Japanese Patent Application No. 2017-024712 filed in Japan Patent Office on Feb. 14, 2017, the contents of which are hereby incorporated by reference.

Although the present invention has been fully described by way of example with reference to the accompanying drawings, it is to be understood that various changes and modification will be apparent to those skilled in the art. Therefore, unless otherwise such changes and modifications depart from the scope of the present invention hereinafter defined, they should be construed as being included therein.

The invention claimed is:

1. A winch control apparatus for a crane, comprising:

a winch drum around which a wire rope for suspending a suspended load is wound;

an electric motor which drives the winch drum in a hoisting direction and a lowering direction;

a rotational speed detection section which detects a rotational speed of the electric motor;

a manipulation unit to which a hoisting manipulation for driving the winch drum in the hoisting direction is input;

a load detection section which detects a load value of the suspended load;

a brake which restrains the electric motor from a rotational movement;

a brake control section which releases the restraint by the brake, when the hoisting manipulation is input;

a first compensation torque value calculation section which calculates, when the hoisting manipulation is input, based on a difference speed between the detected rotational speed and a target speed according to a manipulation amount of the hoisting manipulation, a first compensation torque value for enabling the electric motor to generate a reverse-rotation-preventing torque which is a torque in the hoisting direction corresponding to the difference speed;

a second compensation torque value calculation section which calculates, when the hoisting manipulation is input, based on the detected load value, a second compensation torque value for enabling the electric motor to generate a load bearing torque which is a torque in the hoisting direction and necessary for bearing a load of the load value;

a command value calculation section which calculates a first command value for making a deviation between the detected rotational speed and the target speed to be zero, and adds the first and second compensation torques to the first command value to thereby calculate a second command value; and an electric power conversion unit which supplies an electric power according to the second command value, to the electric motor.

2. The winch control apparatus as recited in claim 1, wherein the first compensation torque value calculation section calculates, when the hoisting manipulation is input, until the detected rotational speed reaches the target speed, the first compensation torque value using at least one of the difference speed and a differential acceleration obtained by differentiating the difference speed.

3. The winch control apparatus as recited in claim 1, wherein the load detection section is formed of a load meter for measuring the load value of the suspended load.

4. The winch control apparatus as recited in claim 1, wherein the load detection section comprises an ammeter for measuring a current value which is a value of current to be input into the electric motor, and a load calculation section for calculating the load value of the suspended load from the measured current value.

5. The winch control apparatus as recited in claim 1, wherein the second compensation torque value calculation section calculates, as the second compensation torque value, a value which is less, by a given value, than a torque corresponding to the load value detected by the load detection section.

6. The winch control apparatus as recited in claim 1, wherein the command value calculation section comprises:

a speed controller for calculating a d-axis current target value and a q-axis current target value for making the deviation between the detected rotational speed and the target speed to be zero;

a first subtractor for calculating, as a d-axis current command value, a deviation between a d-axis current value of a current to be supplied to the electric motor, and the d-axis current target value;

a first current controller for calculating a d-axis voltage command value for making the d-axis current command value to be zero;

a second subtractor for calculating, as a q-axis current command value, a deviation between a q-axis current value of the current to be supplied to the electric motor, and the q-axis current target value;

a first adder for adding the second compensation torque value to the q-axis current command value;

a second current controller for calculating a q-axis voltage command value for enabling the added value obtained by the first adder to become zero; and a second adder for adding the first compensation torque value to the q-axis voltage command value.

7. A crane comprising the winch control apparatus as recited in claim 1.

* * * * *